United States Patent [19]

Donzis

[11] 4,217,705

[45] Aug. 19, 1980

[54] SELF-CONTAINED FLUID PRESSURE FOOT SUPPORT DEVICE

[76] Inventor: Byron A. Donzis, 24 Lana La., Houston, Tex. 77027

[21] Appl. No.: 928,425

[22] Filed: Jul. 27, 1978

Related U.S. Application Data

[63] Continuation-in-part of Ser. No. 842,250, Oct. 14, 1977, which is a continuation-in-part of Ser. No. 774,276, Mar. 4, 1977, abandoned.

[51] Int. Cl.[2] ..... A43B 13/20; A43B 13/38

[52] U.S. Cl. ..... 36/29; 36/44; 128/594

[58] Field of Search ..... 36/29, 28, 44, 43, 3 B, 36/30 R; 128/594, 588; 428/12, 257, 267, 424, 425

[56] References Cited

U.S. PATENT DOCUMENTS

| | | | |
|---|---|---|---|
| 586,155 | 7/1897 | Bascom | 36/29 |
| 1,010,187 | 11/1911 | Scott | 36/29 X |
| 1,056,426 | 3/1913 | Kenny | 36/29 |
| 1,148,376 | 7/1915 | Gay | 36/29 |
| 1,304,915 | 5/1919 | Spinney | 36/29 |
| 1,498,838 | 6/1924 | Harrison | 36/29 |
| 2,080,499 | 5/1937 | Nathansohn | 36/29 |
| 2,177,116 | 10/1939 | Persichino | 128/594 |
| 2,682,712 | 7/1954 | Owsen | 36/29 X |
| 2,863,230 | 12/1958 | Cortina | 36/29 |
| 3,120,712 | 2/1964 | Menken | 36/29 |
| 3,675,377 | 7/1972 | Suter | 428/12 X |
| 3,765,422 | 10/1973 | Smith | 36/29 X |
| 3,871,117 | 3/1975 | Richmond et al. | 36/43 |
| 3,974,989 | 8/1976 | Goodfellow | 428/257 |
| 4,063,562 | 12/1977 | Smith | 128/594 |
| 4,100,686 | 7/1978 | Sgarlato et al. | 36/29 |
| 4,129,951 | 12/1978 | Petrosky | 36/29 |

FOREIGN PATENT DOCUMENTS

| | | | |
|---|---|---|---|
| 467772 | 3/1929 | Fed. Rep. of Germany | 36/29 |
| 996111 | 8/1951 | France | 36/29 |
| 358205 | 10/1931 | United Kingdom | 36/29 |

*Primary Examiner*—James Kee Chi

*Attorney, Agent, or Firm*—Arnold, White & Durkee

[57] ABSTRACT

A device which supports and cushions the human foot by means of fluid pressure is disclosed. The device is non-elastic and self-supporting. Two superimposed plies of a fluid impervious woven fabric material are sealed to each other around the periphery and, according to predetermined design, at selected areas within the periphery. The result is a series of foot supporting pneumatic cushions interspersed and separated with void regions which do not touch the underside of the foot. The fluid containing chambers which form the pneumatic cushions are in communication with each other through fluid passageways located around the periphery of the device. The device permits fluid to flow from one internal chamber to another when compressed, but with a back pressure build up sufficient to prevent sudden surges of fluid from one chamber to another. This provides additional pressure which resists and cushions the impact of the forces applied to the device.

10 Claims, 12 Drawing Figures

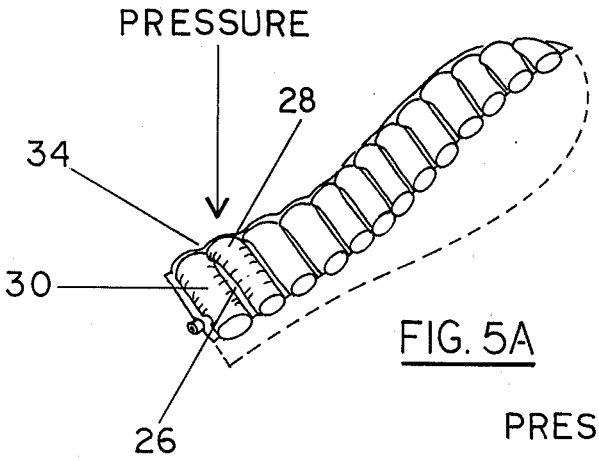
FIG. 5A
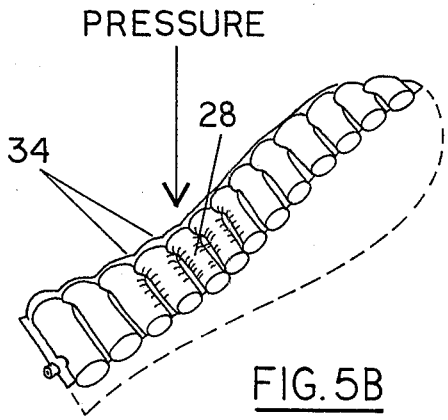
FIG. 5B
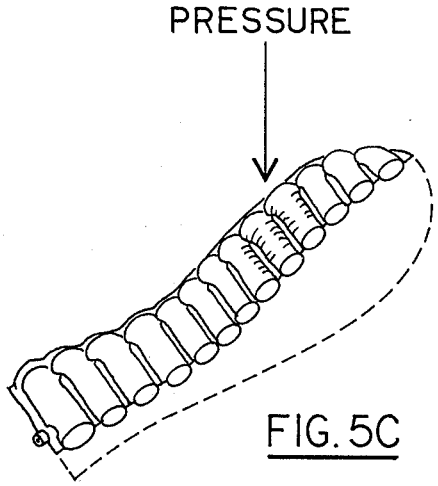
FIG. 5C
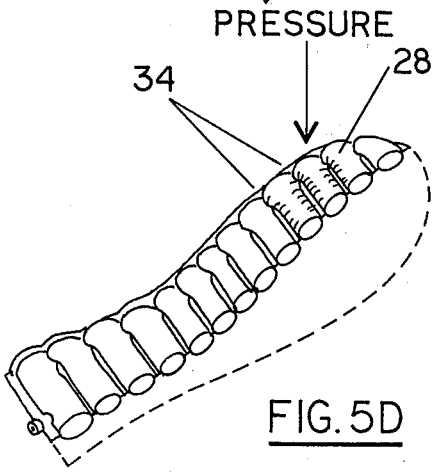
FIG. 5D
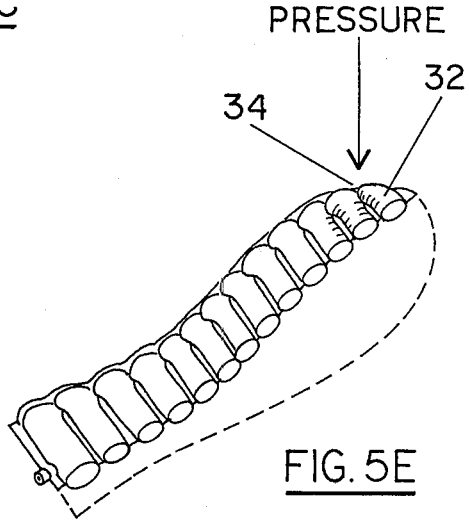
FIG. 5E
FIG. 5

SELF-CONTAINED FLUID PRESSURE FOOT SUPPORT DEVICE

REFERENCE TO RELATED APPLICATIONS

This application is a continuation-in-part of U.S. application Ser. No. 842,250, filed Oct. 14, 1977 and now pending, which in turn is a continuation-in-part of U.S. application Ser. No. 774,276, filed Mar. 4, 1977 and now abandoned.

BACKGROUND OF THE INVENTION

Recognition of the individuality of foot support problems is implicit in medically developed orthopedic shoes and critically desirable in shoes for recreational and athletic endeavors. Although some attempts have been made to make individually adjustable supports for shoes more amenable to a mass-production process, devices currently available have to be painstakingly fitted to each deformity for orthopedic use and lack the capability of being accommodative and dynamically adaptive during any use.

Biomechanical studies of the human gait cycle have focused attention on the desirability of providing additional cushioning and support at certain critical areas of the foot. One theory, e.g., would require a foot support device to provide an extra fraction of a second of support to the heel in order to reduce the shock of the "strike" portion of the gait cycle. Moreover, these studies have indicated that the weight of a foot cushioning device plays a very significant part in determining the overall effectiveness of the device. For these and other reasons, interest has continued over the years in the development of a practical, effective pneumatic cushion.

The concept of having the sole portion of a shoe fabricated so as to define a hollow inflatable cavity therein has long been disclosed, but without commercial realization. U.S. Pat. Nos. 508,034 (Moore), 572,887 (Gallagher), 580,501 (Mobberley), 1,056,426 (Kenny), 1,148,376 (Gay), 1,304,915 (Spinney), 1,498,838 (Harrison, Jr.), 1,639,381 (Manelas), 2,605,560 (Gouabault), 2,863,230 (Cortina), 3,120,712 (Menken), 3,785,069 (Brown), 4,012,854 (Berend), British Pat. No. 7507 (Crawford), British Pat. No. 358,205 (Marling), French Pat. No. 996,111 (Milonas), all disclose boots or shoes with a sole having a cavity defined therein for supporting a pneumatic cushion. Further, U.S. Pat. Nos. 508,034 (Moore), 1,010,187 (Scott), 1,148,376 (Gay), and 2,682,712 (Owsen) disclose inflating openings or valve arrangements disposed in cooperative association with a cavity defined within the shoe. Yet further, U.S. Pat. No. 3,871,117 (Richmond) discloses a shoe wherein energy supplied by the movement of the wearer in walking pumps a cooling fluid through a cavity disposed within a sole and a tubular cooling fin arrangement in communication therewith disposed along the sides of the shoe upper.

Generally, such prior attempts at providing pneumatic cushioning of the foot have involved a single fluid receiving bladder, tubular in shape, which was supposed to provide cushioned support to the entirety of the wearer's foot. Although providing some measure of cushioned support, such tubular members, or bladders, have had a number of problems. For example, with shoes containing a single fluid receiving cavity the wearer must become accustomed to a rock and sway motion. That is, with any weight shift while wearing such equipped shoes the wearer will rock side-to-side and sway front-to-back as the fluid is continually displaced. Other problems were in deflation and replacement and in the size and weight of the shoes necessary to contain such bladders. Moreover, even the best concepts of inflatable pneumatic cushions had limited orthopedic value in that they could not effectively be adapted to truly cushion injured or diseased feet while at the same time being practical for normal walking endeavors.

It would be advantageous to provide a pneumatically cushioned shoe which does not alter the structural integrity of the sole or heel portions thereof nor add any significant weight which would have to be lifted by the wearer. Further, to gain additional orthopedic and comfort advantages provided by walking on a volume of pressurized fluid, it would be advantageous to provide a foot support member which could be made according to a preselected design to contact only certain portions of the foot dependent upon the nature of the wearer's orthopedic concerns. Such a shoe or a foot support member should most advantageously be lightweight, and readily producible.

Except as discussed herein, in none of the art cited above does it appear possible to easily replace or clean a bladder (if one were provided) or to repair a rupture of the fluid containment volume. Accordingly, these shoes once rendered nonfunctional would ordinarily be discarded. Although Scott, U.S. Pat. No. 1,010,187, shows access to the bladder may be gained by unlacing a portion of the shoe located at the heel and thereof and withdrawing the bladder through the heel portion and Owsen, U.S. Pat. No. 2,682,712, describes the need for unlatching clasps located in the toe and heel portions of the shoe to remove the lower sole thereby gaining access to the bladder, these expedients are believed to be cumbersome and non-advantageous in practice. Thus, it would be advantageous to provide a shoe with an easily and expeditiously replaceable bladder disposed therein. Additionally, it would be advantageous to provide ready access to the bladder to facilitate replacement or repair as warranted by orthopedic considerations, among others. Providing such an inflatable member in the shoe of the wearer would, in addition to providing the advantage of walking on a pneumatic layer of fluid, such as, for example, air, insulate the foot of the wearer from cold and heat. Yet further, wearer comfort in any field of endeavor can be enhanced through the utilization of the shoe having an inflatable support member disposed therein.

SUMMARY OF THE INVENTION

In its broadest aspects, the present invention is a self-contained device adapted to cushion and support the foot by means of fluid pressure. The device comprises two superimposed plies of thin, lightweight, non-elastic, flexible, fluid-impervious woven fabric material, of a shape generally suited to support a foot, or selected portions of a foot, the adjacent surfaces of which are sealed around the periphery thereof to form a pressure-tight inflatable bladder which, when filled with fluid under sufficient pressure to adequately support and cushion the forces applied by the human foot, does not distend or lose its shape.

The device is further characterized in that the adjacent surfaces of the fabric material are additionally sealed at preselected regions within the periphery, thus defining a plurality of fluid-containing chambers within the bladder, each functioning as a pneumatic cushion to support a portion of the weight load on the foot. The interior sealing which defines the chambers within the bladder does not fully seal off each chamber to isolate it from the others (although selected chambers may be isolated). Rather, fluid passageways are defined at the periphery of the bladder during the sealing process which enable fluid communication between at least some adjacent chambers. The fluid passageways are sized to restrict fluid flow from one chamber to another so as to prevent surges of fluid from one chamber to another when forces are applied to the outside surface of the bladder and to cause a momentary build-up of pressure within a chamber when sudden, strong forces are placed on that chamber, thus providing an extra measure of cushioning effect.

Means are provided for inflating the several fluid-containing chambers of the device to the appropriate internal pressure and for deflating the device when necessary or desirable. This may take the form of one or more valves secured in the bladder wall at the appropriate location or locations. As will be understood, when one or more chambers are sealed off from the remaining chambers of the bladder, thus forming at least one additional inflatable region, a separate valve must be provided for each inflatable region.

The device of the present invention provides a measure of support and cushioning response which is extraordinary in relation to its size and weight. It does not merely absorb the energy of the forces placed on it, but returns most of the energy in these forces, in a distributed upward fashion, thereby providing significant support as well as cushioned comfort to the wearer. The device finds its most valuable utility as an inflatable insert for shoes. As such, it may be placed within a receiving area defined within a shoe member, may be placed between the insole and the outer sole of the shoe or may be utilized directly as the insole. The device may also be utilized as a cushion for only selected portions of the foot, for example the heel or the arch portions, in which case it must be secured within the shoe by any suitable means. However, it is an important feature of the invention that the device is self-contained, that is, it need not be supported or contained within a specially constructed region of the shoe or footpiece in order to be fully functional. Thus, it may be made to be easily removable and replaceable. It may also be utilized by itself in the manufacture of extremely lightweight footwear, such as sandals and/or slippers, with nothing more attached to the device than that necessary to keep it on the foot and protect it from excessive wear.

The opposing surfaces of the fabric material which makes up the walls of the device of the present invention may be adhered to each other by any suitable technique, including the use of adhesive, the only criterion being that an effective seal be formed. The preferred technique involves heat sealing according to established techniques (including the use of RF radio signals). By sealing selected regions within the periphery of the device according to a predetermined pattern and/or design, the size, shape, number and arrangement of the fluid-containing chambers within the device may be adapted to take into consideration the peculiar needs of the individual wearer. For example, certain foot anomalies may call for little or no pressure at particular locations of the foot. The device of the present invention may be adapted to provide sealed preselected regions which not only define one or more fluid-containing chambers within the device, but also define entire separate areas of the overall surface of the device which do not contain any fluid whatsoever. When the device is inflated, these areas will tend to be recessed and I have used the term "voids" to refer to these recessed areas. These void areas, totally surrounded by pneumatic cushions, are particularly valuable in orthopedic treatment of the foot, isolating certain portions of the foot, by predetermined design, from pressure and/or chafing in order to promote healing or otherwise correct an improper foot condition.

In a preferred embodiment, the device of the present invention comprises a foot-shaped bladder, to be inserted within a bladder-receiving region defined between the tread piece and upper of a shoe. An insole is positionable on the upper surface of the bladder, when the bladder is disposed within the bladder-receiving region, and has an access slit extending a predetermined length longitudinally therethrough to afford access to the bladder. Means for removably attaching the bladder to the inner surface of the tread piece is provided. Additionally, means may also be provided for attaching the insole to the upper surface of the bladder.

In order to accommodate displacement of the pressurized fluid as the fluid responds to pressure exerted by the foot of a wearer, the insole may be freely movable along the longitudinal axis of the tread piece, along the transverse axis of the tread piece and along an axis of the tread piece normal to a plane containing the longitudinal and transverse axes. Alternatively the insole may be fixedly attached to the tread piece whereby the insole is freely movable along an axis of the tread piece normal to a plane containing the longitudinal and transverse axes of the tread piece, again to accommodate displacement of the fluid as the fluid responds to pressure exerted by the foot of a wearer.

The tread piece is provided with a flap disposed along each side of the tread piece, each flap positionable between the insole and the upper surface of the bladder and overlying a portion of the upper surface of the bladder to aid in joining the upper to the tread piece.

The inflating means may be positioned to extend through the tread piece thereby permitting introduction of pressurized fluid into the bladder without removing the bladder from the bladder-receiving region within the tread piece. Alternately, the inflating means may be positioned on the bladder and within the bladder-receiving region.

BRIEF DESCRIPTION OF THE DRAWINGS

The invention will be more fully understood from the following detailed description, taken in connection with the accompanying drawings which form a part of this application and in which:

FIG. 5 and FIGS. 5A–5E depict in partial cross-section a series of illustrations showing how the fluid would move within one embodiment of the device of the present invention as that device is subjected to the various forces and pressures typical of the sequential stages of the human gait cycle.

DETAILED DESCRIPTION OF THE INVENTION

Figure 1:
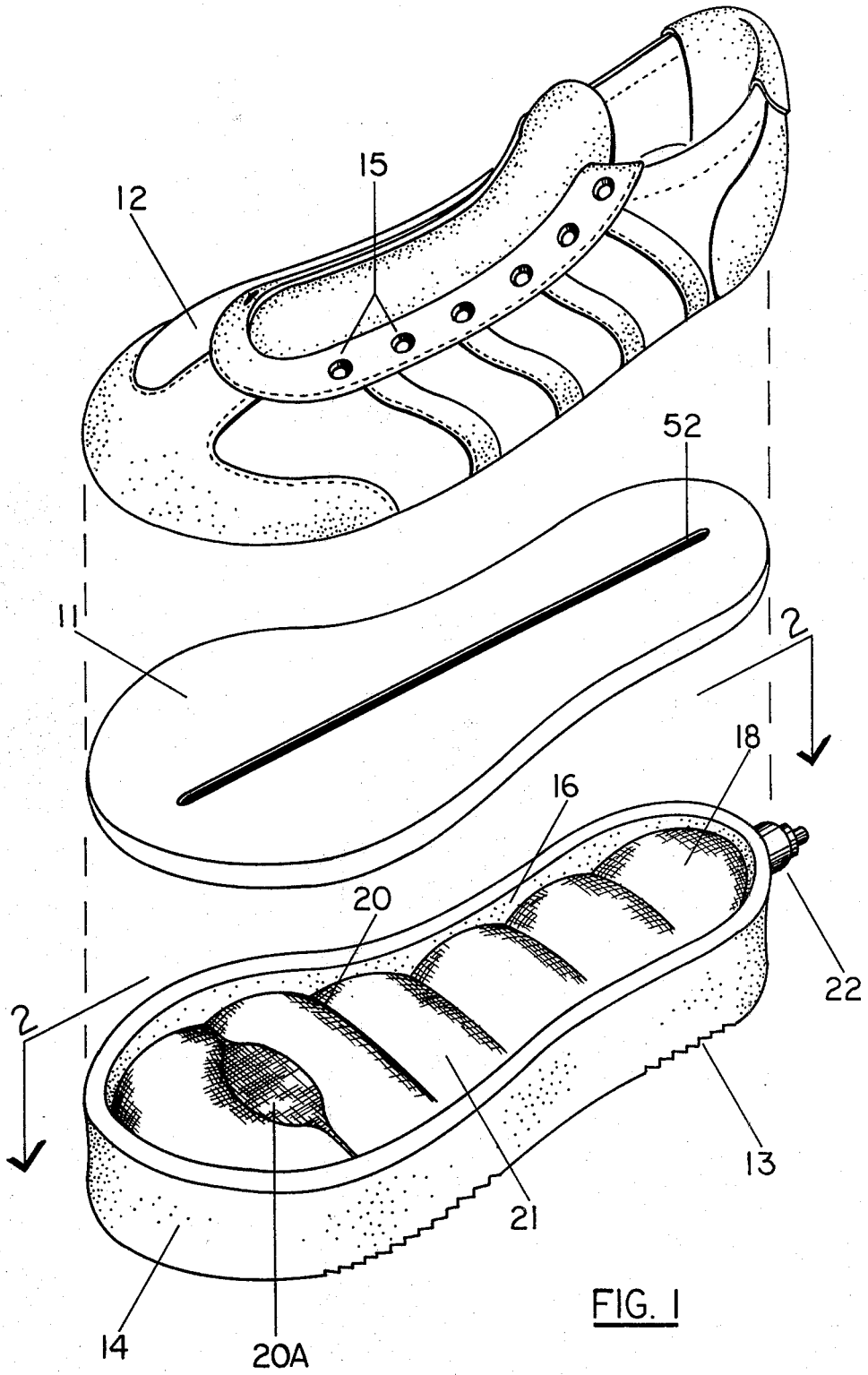
FIG. 1 is a partially exploded view of a shoe illustrating an inflatable device of the present invention as it would be disposed in a bladder-receiving region defined by a tread piece, an upper and an insole of the shoe.

Throughout the following description, similar reference numerals refer to similar elements in all figures of the drawings.

Referring now to FIG. 1, there is shown an exploded view of a shoe embodying the teachings of this invention. The shoe comprises an upper portion 12 which may be fixedly attached to a tread piece 14 which, in turn, may or may not include a separate heel at 13. The upper 12 is provided with tightening means 15, which may be any generally suitable means, for example, clasps, snaps, or eyelets and string. Attachment of the upper 12 to the tread piece 14 is effected by state of the art techniques, including vulcanizing, sewing, the use of an adhesive, or the like.

The tread piece 14 and the upper 12 cooperate to define a bladder-receiving region 16 therewithin. Disposed within region 16 is a flexible bladder device 18 made according to the present invention. The device shown is provided with a valve 22, which is preferably a check valve, for the purpose of introducing and/or adjusting the amount of pressurized fluid in the bladder 18. As shown, the valve 22 is preferably positioned at the heel region and extends through the wall of the tread piece for access without having to remove the device from the shoe. As will be readily apparent, the valve may be positioned anywhere on the bladder and may extend from the bladder through any portion of supporting region 16. Alternatively, the device of the present invention may be pressurized during the manufacturing process and thereafter sealed completely, eliminating the need for the above described valve, but also eliminating the valuable function of pressure adjustability.

As shown in FIG. 1, a separate insole 11 may be disposed above the bladder-receiving chamber between the upper and the tread piece. Any suitable means of attachment may be provided by which the insole may be secured to the bladder-receiving region. Alternatively, the insole may be simply placed on top thereof, fitting snugly but nevertheless providing some freedom of movement of the insole with respect to the tread piece. In this alternative configuration, it is preferred to provide a means by which the insole moves only with movement of the inflatable bladder device. This may be readily accomplished, for example, by providing for a Velcro fastener or the like between the underside of the insole and the top surface of the inflatable bladder. It will be understood that any equivalent fastening means by which the bladder and the insole may be fixedly attached will be acceptable.

In most cases, the insole 11, as shown in FIG. 1, may be dispensed with, the upper surface of the inflatable device of the present invention functioning directly to support and cushion the foot. However, where an insole is preferred or required, the insole may be provided with one or more slits, shown as 52 in FIG. 1, positioned longitudinally for a suitable length along the axis of the insole. The slit 52 will aid in the positioning and removing of the bladder 18 by providing ready access to the bladder through the slit insole.

Figure 2A:
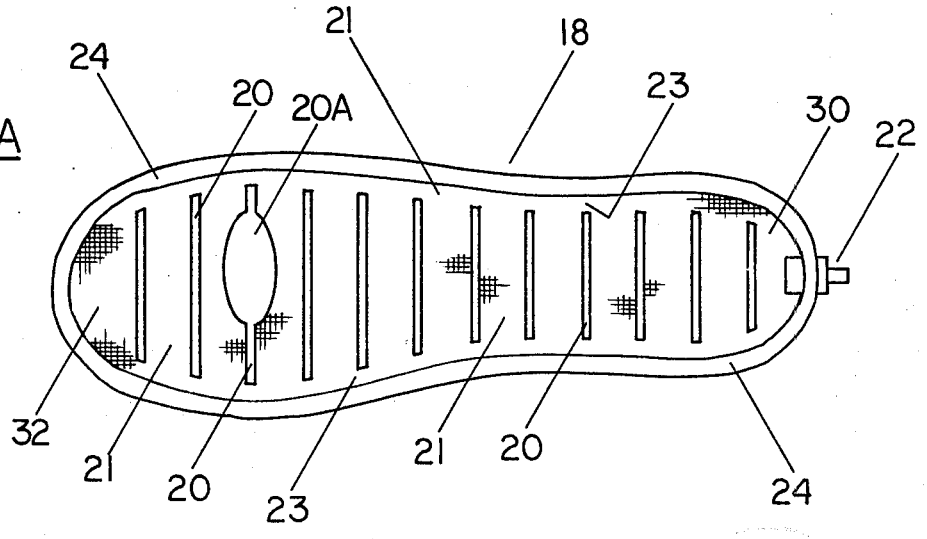
FIG. 2 is a plan view taken along the lines 2—2 of FIG. 1 illustrating the internal sealing pattern of the preferred design of an inflatable tubular member made according to the present invention for use as cushioning insert (in FIGS. 2A, 2B and 2C, three different design layouts are shown for the fluid-containing chambers which function as pneumatic cushions)
Figure 2B:
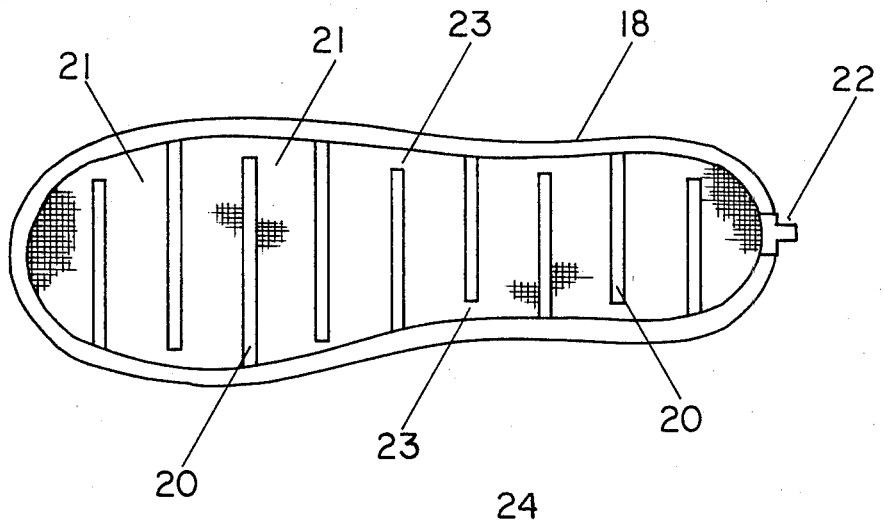
Figure 2C:
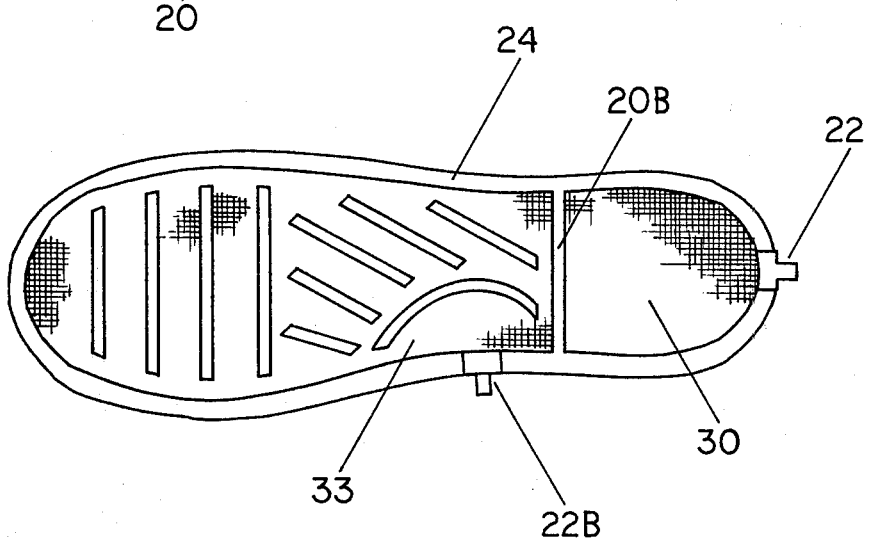
Figure 3:
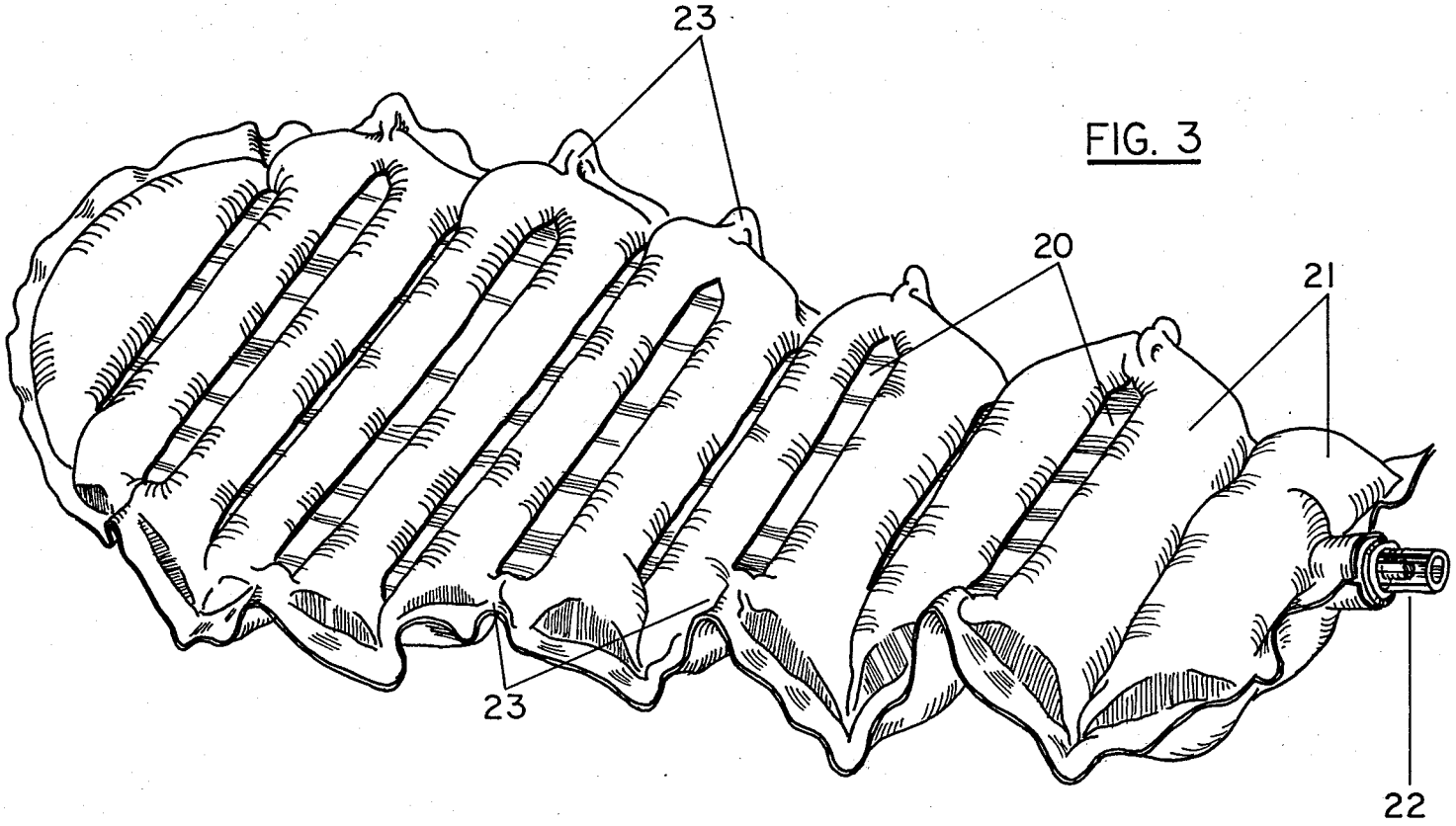
FIG. 3 is a perspective view of the device of the present invention shown fully pressurized to illustrate how the bladder folds over on itself at the sealed regions resulting in a further restricted passage of fluid between communicating inner chambers.

Referring now to FIGS. 2 and 3, the details of the novel and unique inflatable bladder device of the present invention may more fully be understood. As will be observed, the device 18 is of a shape generally suited to support a foot, or selected portions of a foot. The device 18 shown in the accompanying drawings is a full foot support device. However, it should be understood that the device may be manufactured so that it will inflate only to support certain regions, such as the heel region or the arch region of the foot, or it may be manufactured to be of a size and shape to permit support only of certain portions of the foot. In the latter case, means will have to be provided to secure the device below the particular portion of the foot to be supported. It is preferred, however, to form the device as shown in the drawings, as a generally tubular shaped bladder 18 having its upper and lower opposing inner surfaces sealed to each other at regions 20 to form a plurality of foot supporting cushions 21 when the bladder is pressurized with a suitable fluid, such as air, water, or the like.

It is a feature of the present invention that the material of which the inflatable device is made has sufficient strength to be integral and self-supporting, while at the same time being lightweight and flexible. It is, in addition, critical that the bladder device of the present invention be capable of retaining and supporting its own shape under the limited amount of internal fluid pressure to which it will be subjected during proper functioning as a foot support device. In other words, it does not stretch or "balloon" out of shape when supporting the weight of the wearer or when subjected to sudden and sharp increases in internal pressure as will be experienced during the human gait cycle. In addition, it is capable of supporting its own structure without necessarily being contained by some rigid supporting material, either in addition to or integral with the chamber within which the device is to be inserted. This last characteristic provides the device with the valuable capacity of being made to a precise shape. For example, all foot sizes may be provided for. Also, the device may be made with a wedge-shaped cross-section. That is, it may be made to have either a positive or a negative heel.

The preferred material for the manufacture of the device of the present invention is a woven fabric of a suitably strong, non-elastic fiber, such as nylon, polyester or aramid, made fluid impervious by coating it on at least one side with a natural or synthetic elastomeric material, such as rubber, polyisoprene or polyurethane. Other suitable strong, fiber materials which may be square-woven into a textile sheet material which is non-elastic and of sufficient strength to resist puncture and the like will be obvious to those having ordinary skill in this art. Also, although not preferred, hydrophilic fibers such as cotton, linen and the like may be utilized, in which case it would be preferable to thoroughly impregnate the fabric, by coating it on both sides with the elastomeric material, for example. As always, the critical criteria for suitability will be the weight of the material and its strength and resistance to "ballooning". Prior art materials, such as natural rubber do not hold their shape. Other materials, such as polyvinylchloride (pvc), or the like, lose their flexibility and become too heavy when used in thickness adequate to prevent "ballooning" under pressure.

The device is formed by first superimposing two layers of the flexible, fluid impervious fabric material and sealing the adjacent faces around the periphery thereof to form a pressure-tight inflatable bladder. The sealing may be accomplished by any suitable technique, including the use of a cement adapted for bonding the particular rubber material used in coating the fabric. However, heat sealing according to established techniques well known in the art is the preferred sealing method. Heat sealing provides for flexibility and adaptability in manufacturing, which is important in producing the internal sealing patterns discussed below. As will be apparent, whatever sealing technique is employed, the resulting seal must be adequate to withstand the internal pressures created when the device is inflated, but more importantly, when the inflated device is subjected to the external forces of anticipated use. These forces, produced by the shifting weight of the wearer, will tend to compress the device, drastically increasing the internal pressure. For example, a device inflated to an internal pressure of 5 psi, usually sufficient to prevent "bottoming out", will develop pressures of 25 psi, or more, during use.

In addition to sealing at the periphery 24, preselected regions 20 internally of the periphery are sealed off according to a design determined at least in part by the intended end use of the device. As shown in the drawings, the internal sealing of the device results in the formation of a plurality of communicating chambers 21, each functioning as a pneumatic cushion when the device is pressurized. Fluid communication between chambers is by means of passageways 23 located around the periphery of the device which are formed by leaving an unsealed region between the sealed internal regions 20 and the peripheral seal 24. It is essential that the fluid communication be at the periphery in order that a controlled restricted fluid flow may be provided. In prior art devices incorporating any degree of fluid flow between two or more chambers, communication between chambers was typically by means of passageways and/or valves located in the middle of the inflatable device. Such prior devices tended to lose pressure and, as a result, it was inevitable that a "bottoming out" of the foot would eventually occur, blocking off fluid passage between chambers and destroying the functional value of such passageways. When mechanical valving was involved, such loss of internal pressure would cause the foot to hit the valve, clearly an undesirable situation.

The devices of the present invention effectively eliminate these concerns. Further, in cooperative combination with the flexible, adaptive sealing technique and the resistance of the fabric to deformation under pressure, the peripheral fluid passageways of the invention may be adapted to restrict air flow according to a positive, functional plan. With reference to FIGS. 2A, 2B and 2C, it will be seen that the pattern of interior sealing may be adapted to provide for a wide variety of internal fluid flow patterns. To take into account the varying forces placed upon the device of the present invention as the device is worn during the human gait cycle, it will be preferred to locate and size the air passageways to restrict flow generally from the lateral side of the heel chamber forward, from the lateral ball and forefoot chambers medially, and from the lateral and medial ball and forefoot chambers forward. At the same time, fluid communication between chambers should be adapted, in combination with chamber size and shape, to maximize the flow of fluid from all chambers backward, from the medial side of the heel chamber forward and from the medial ball and forefoot chambers laterally.

It will become apparent to those skilled in the art that many different design patterns may be utilized, combining the size, location and pattern of the peripheral fluid passageways with the number, size, shape and pattern of the fluid-containing chambers to produce an appropriate fluid communication and restricted flow pattern to maximize the effectiveness of the device of the invention for a particular utility. As shown in FIG. 2C, for example, an extra large heel chamber 30 may be provided to taken into account the stronger forces exerted on the heel under some circumstances. The heel chamber may be totally sealed off from the rest of the device by extending region **20*b* during the heat sealing process to meet with the peripheral seal 24, thereby preventing communication of chamber 30 with the other chambers of the device. In the design shown in FIG. 2C, a larger chamber 33 has also been proposed for the arch portion of the device, with an additional inflation means 22*b* provided extended through the sidewall of the device to provide for inflation of the frontal regions. As will be observed, the pattern of sealing the strip regions 20** within the periphery of the device may be adapted in a variety of ways to provide fluid flow patterns more suitable for particular end uses. Different uses, for example, standing, walking, running or stop-start recreational uses such as tennis, will obviously command different restricted flow patterns. The devices of the present invention may be readily adapted to meet these needs.

Because the device is made of a fabric which tends to resist distention and stretching when it is inflated (or, more correctly, pressurized), there is a natural lateral shrinkage which results in the device "crinkling" or folding over on itself at points of lesser internal structural support when such pressurization occurs. This is illustrated in FIG. 3 of the drawings. In the design of the device shown in the drawings, this creasing will occur at the passageways 23 communicating between chambers, thereby causing the passageways to become even more restrictive to the flow of fluid. The size of the passageway and the tendency of the walls to constrict around it because of the above-mentioned effect, serve to provide an internal valving which aids to minimize surges of fluid pressure within the device as the external weight placed upon it varies, for example during the natural gait cycle. In the normal human gait cycle, the actual forces created by the moving weight of the foot do not fall on the outer periphery of the foot but rather on a somewhat oblique line from the heel to between the big and second toe. By providing for air passage from chamber to chamber to occur around the periphery of the device of the present invention, additional support from front to back as well as from side to side is provided. The forces exerted by the foot, rather than working against fluid passage between chambers, cause the fluid to flow naturally to those areas where it is most needed to compress and cushion the weight of the foot.

In a second respect, the internal sealing of the superimposed layers which make up the device of the present invention totally closes off preselected regions 20 of the device from any fluid flow whatsoever. Thus, when inflated, regions of the device will exist which do not provide any cushioning. These will naturally be recessed areas when viewing the device from outside and I have used the term "voids" to refer to these recessed areas. By preselecting the design pattern, size and shape of these voids which are created during the sealing process, they are able to be used in conjunction with the cushioning portions of the device to provide very valuable features. Thus, for example, larger void regions, as shown at 20*a* in FIG. 2A, may be created which are particularly valuable in the field of podiatrics, especially orthopedic treatment of the foot, where certain portions of the foot must be isolated from pressure and/or chafing in order to promote healing. Quite obviously, the primary function of the strip regions 20 is to define the boundaries and shape of fluid containing chambers 21. As such, the width of these regions 20, as opposed to their length, may be no more than is necessary to assure an adequate seal under the pressures to be accommodated. Nevertheless, preliminary studies have indicated that a minimum of approximately 20% of the total surface area of the foot support device ought to be taken up with these heat sealed regions which I have called "voids". In other words, the purpose of the void is not simply to delineate and separate the fluid-containing chambers. Rather, the voids are to be considered an integral aspect of the design of the devices of the present invention. In combination with the pneumatic cushions, the void areas contribute to the total cushioning and supporting effect of the devices of the invention. The size, shape and number of these voids should be taken into account equally along with the size, shape and number of the fluid cushions and the size, and shape of the fluid communication passageways in creating the overall pattern of fluid flow and internal pressure necessary to provide for an effective device.

The design of the heat sealing to produce the voids above-mentioned may be particularized and adapted to suit the individual needs of a patient. As illustrated in FIGS. 2A–C of the drawings, any number of patterns may be conceived by which the internal regions of the device are sealed off to form, on the one hand "voids", and on the other hand, the internally communicating chambers which provide for the pneumatic cushioning of the device.

The device of the present invention finds particular utility in three general areas of footwear. In the field of athletic, or sport, and recreational footwear, the emphasis is on strength and effectiveness combined with lightweight. Different demands are placed on a shoe which might be used for running as compared with a shoe which would be used for basketball or tennis. Nevertheless, each of these endeavors require a lightweight shoe. It has been demonstrated that to walk or run a mile, the average person lifts his foot approximately 1,500 times. Even the lightest weight results in an enormous amount of lifting during any extended walking, running or playing endeavor. The device of the present invention, in its preferred embodiment, weighs less than one ounce and has a strength and structural integrity factor equal to the strongest cushioning devices.

In the field of military and work footwear, while weight remains important, its importance is secondary to the ability of the device to provide long-lasting, effective cushioning. The device of the present invention is extremely resistant to puncture, is convenient to inflate and deflate to the desired pressure at any time, and is able to withstand extended periods of flexing and rubbing without a noticeable effect on the structural integrity.

In the field of podiatrics, especially orthopedic treatment of the foot, the device finds particular utility in that it may be adapted to suit the individual needs of the patient, both by adjusting the internal pressure to increase or decrease support at certain areas and also, by predetermined design, to eliminate whole regions where any contact at all is made with the undersurface of the foot. Because the device is constructed of a non-elastic material, which does not distend when subjected to increases in internal pressure, the surface area and structure of the device may be precisely designed according to predetermined functional intent. The device is also capable of being fitted precisely to any size and shape of foot, and it will maintain that shape and size.

The inflation valve 22 for use with the device of the present invention provides a very important role. The valve must be lightweight, small in size and capable of withstanding sharp and severe increases in internal pressure without leakage. It should be easy to work with and capable of being located in an area where it will not be subject to flexing or in contact with the bottom of the foot. I have found that the valve adapts better to the heat sealing process when it is placed within a suitable plastic tube, which tube is then sealed into the periphery of the inflatable bladder. In this manner, the valve does not come into contact with the foot and is more readily made accessible from the outside of a shoe or tread piece. A particularly suitable valve which meets all these criteria is the 810 Series, two-piece auto check valve manufactured by Halkey-Roberts Company of Paramus, New Jersey and described in U.S. Pat. No. 3,831,629. This valve is conveniently used with a hand held, manually operated pump also manufactured by Halkey-Roberts and utilizing the valve shown in U.S. Pat. No. 3,429,338. This pump and valve combination permit the devices of the present invention to be mass produced but then adapted, by adjusting the internal air pressure to suit the individual needs of the wearer.

Figure 4A:
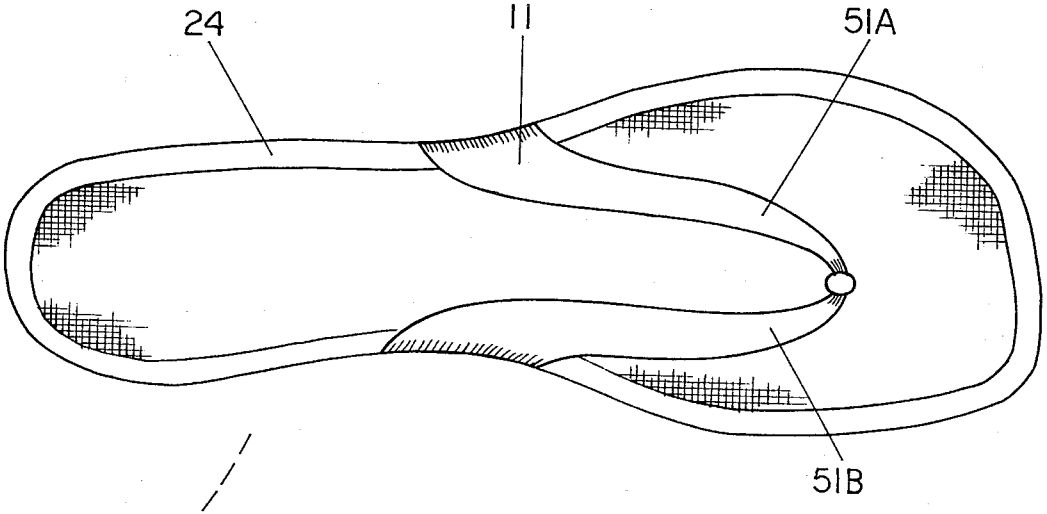
FIGS. 4A and 4B are a representation of an alternative embodiment of the invention, illustrating the utility of the integral, self-contained character of the device, wherein the foot support member itself functions also as its supporting structure.
Figure 4B:
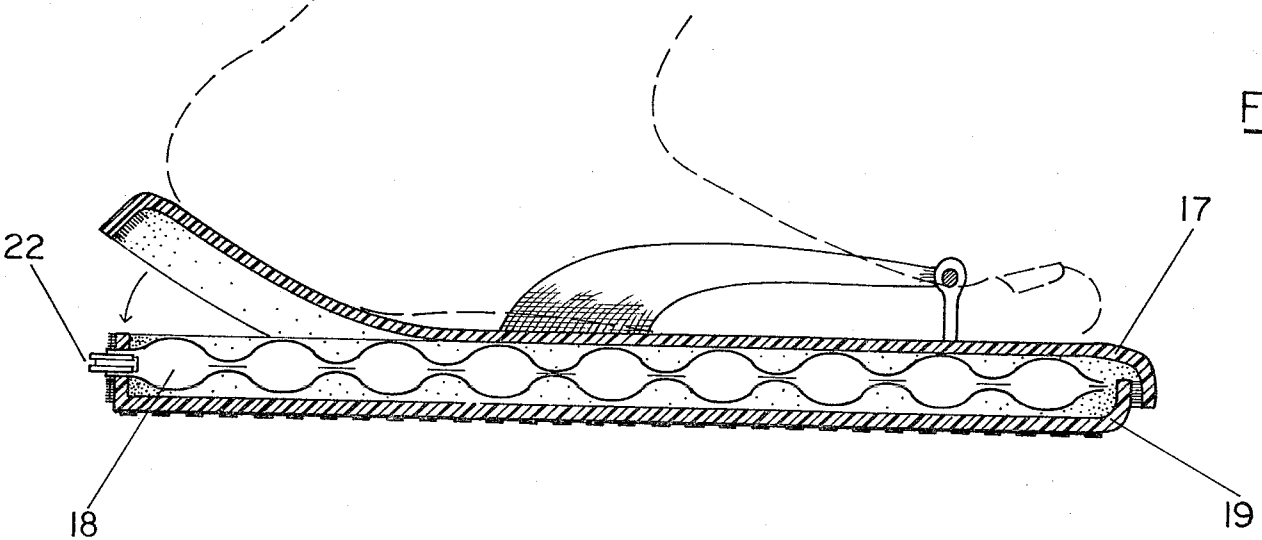

In FIG. 4 of the accompanying drawings, an example of a foot support member is shown which utilizes to the fullest extent, the self-contained, self-supporting nature of the device of the present invention. The inflatable device 18 is shown in place between a thin top layer 17, which may be a fabric material impregnated with an elastomeric material to increase its wear characteristics, and tread pice 19, which may be any suitable sole material. The three pieces are secured to each other by means of opposing strips of VELCRO material, but any suitable means may be employed. The use of a fastener such as VELCRO is desirable, since this will permit any one of the three pieces to be removed and replaced. Fluid is pumped into the inflatable device 18 by means of valve 22. The composite structure of the three pieces is kept on the foot by means of any suitable arrangement, such as straps 51*a* and 51*b* secured to the top surface of upper layer 17.

As an alternative to having the three layers readily removable from each and inflatble at will, the entire composite device may be formed by placing the three layers 17, 18, 19 on top of each other in the appropriate fashion, inflating the device 18 and then heat sealing the three devices around the periphery as shown at 24 in FIG. 4A.

The device of the present invention is uniquely adapted to respond to the human gait cycle. Accordingly, when the device is included within a footpiece, such as a shoe, and the wearer proceeds in a forward direction, the flexible, cushioning nature of the device responds according to the shifting forces inherent in the human gait cycle. With particular reference to FIG. 5 of the accompanying drawings, the response of a device of the present invention as it relates to the human gait cycle may be observed.

In FIG. 5A, the heel contact or "strike" phase is shown. In this phase almost all of the weight of the wearer is borne down through the heel to the heel portion of the device, which may comprise a heel cushion of pneumatic "pillow" 30 and one or more additional pillows 28. The force of the "strike" of the heel will tend to force from the chambers making up these pillows into adjacent chambers located forward of those receiving the force. However, because of the restricted passageways between communicating chambers, a back pressure will build up in the heel chamber and its adjacent chambers receiving the force, producing a momentary additional resistance to the force and, as a result, additional cushioning effect. Similarly, due to the flexible nature of the device itself, the joints 26 between the chambers will tend to flex, thereby providing an additional momentary restriction to the fluid passageways. This flexing action will continue as the forces in the gait cycle proceed through FIG. 5B (the pronation phase), FIG. 5C (the supination phase), FIG. 5D (the propulsive phase), and FIG. 5E (the toe contact and lift-off phase). Thus, a series of restrictions is produced, forming a valving or baffling action which tends to restrict the movement of the fluid from chamber to chamber and provide additional pressure where it is most needed, that is, in the chambers receiving the outside forces.

In the event pressure is angularly exerted on the device, as during certain side-to-side maneuvers which might be experienced in skiing, for example, this valving or baffling effect will restrict the fluid flow in a lateral direction. The fluid will be forced from that portion of the bladder underlying the wearer's instep to that portion of the bladder underlying the outside area of the foot, but at a restricted flow. Thus, the inside portion of the bladder will continue to provide an additional protective cushion around the inside of the wearer's foot. As the fluid is forced from the inside portion to the outside portion, the outside portion of the foot will also be supported. In all events, the restrictive valving function of the fluid flow passageways acts to assure that those portions of the device receiving the additional external pressure will not be so compressed as to "bottom out". In other words, the wearer will always have all portions of his feet supported on a cushion of fluid during any of the varied maneuvers involved in routine wearing of the device.

The present invention has been described in detail with respect to preferred embodiments thereof as required by the Patent Laws. However, it should be understood that modifications and changes to various aspects of the embodiments and alternatives shown and described may be made while still coming within the spirit and scope of the invention. For example, although the preferred method of making the device of the present invention has been disclosed as superimposing two plies of impregnated, non-elastic fabric, it should be apparent that a single ply, suitably impregnated, mav be used, in which case the single piece of fabric is simply folded over on itself and appropriately sealed. In addition, while emphasis has been placed on a construction to be utilized solely for support of the underside of the foot, the invention may also be embodied in a construction adapted to support and cushion one or more other portions of the foot, either alone or in combination with the underside of the foot. Indeed, with appropriate fabrication design and techniques, an entire shoe, even a boot, may be constructed utilizing only the sealed, inflatable, non-elastic support member of the present invention. Many different combinations of the different variable parameters, such as the cooperative placement of voids and pneumatic cushions, which are involved in construction and use of the device of the present invention, will be apparent to those skilled in this art. It is applicant's intent to be limited only by the following claims in defining the scope of the invention.

What is claimed is:

1. A self-contained foot cushioning device comprising:

two superimposed plies of a lightweight, flexible, non-elastic, fluid-impervious woven fabric material, of a shape generally suited to cushion a foot, or selected portions of a foot;

the adjacent surfaces of which are sealed around the periphery thereof to form a pressure-tight bladder which, when pressurized with a pressurizable fluid under sufficient pressure to adequately support and cushion the forces applied by the human foot, does not weaken or lose its shape;

the adjacent surfaces of which are also sealed within the periphery at preselected regions disposed generally perpendicular to the transverse axis of said bladder to define a plurality of internal chambers within said bladder at least some of which are fluidly communicable with each other;

restricted fluid passageways communicating between adjacent chambers, defined at the periphery of the bladder during the sealing process by leaving unsealed a portion of the surfaces between the peripheral seal and the inner sealed regions of the bladder, and sized appropriately to permit a restricted fluid flow from one chamber to another whereby pressure equalization between chambers may take place when the bladder is pressurized but with a back-pressure build-up effect sufficient to prevent sudden surges of fluid from one chamber to another and to provide additional pressure to resist and cushion the impact of sudden heavy forces on the outside of the chamber.

2. The device of claim 1, further including means disposed at at least one predetermined location on said bladder for introducing pressurized fluid therethrough.

3. The device of claim 1, wherein the fabric material is made from woven aramid fiber and coated on at least one side with polyurethane.

4. The device of claim 3, wherein the adjacent coated surfaces of the fabric are heat sealed to each other.

5. A foot support member comprising:

a pressure-tight bladder, suitably shaped to support at least a portion of the foot, and adapted to contain a pressurized fluid without distending or otherwise losing its shape when pressurized and subjected to the compressive forces associated with the shifting weight of the human foot;

said bladder being further characterized in that the walls thereof are thin, non-elastic and flexible, and at least the inner surfaces thereof are coated with a fluid-impervious thickness of heat sealable material;

a plurality of void, non-pressurizable regions within said bladder defined by sealing together the upper and lower walls of said bladder in a predetermined pattern disposed generally perpendicular to the transverse axis of the bladder, and comprising at least twenty percent (20%) of the total surface of the bladder which is exposed to the foot;

a plurality of internal pressurizable chambers within said bladder, defined by the pattern of said void regions, at least some of which chambers are fluidly communicable with adjacent chambers;

fluid passageways located around the periphery of said bladder to permit pressurized fluid flow between at least some chambers and defined between the outer walls of the bladder and the internal sealed off regions of the bladder, said passageways being sized appropriately such that the fluid flow from one chamber is restricted, when the bladder is pressurized, as a result of the flexible walls of the bladder folding over themselves at the fluid passageways.

6. The foot support member of claim 5, further including means disposed at a predetermined location on said bladder for introducing pressurized fluid therethrough.

7. The foot support member of claim 5, wherein the fabric material is made from woven aramid fiber and coated on at least one side with polyurethane.

8. The foot support member of claim 5, further comprising tread means disposed on the underside of the bladder and means for attaching the support member to the human foot.

9. The foot support member of claim 8 wherein the tread means is detachable from the bladder.

10. A shoe comprising:

(a) a tread piece fixedly attached to an upper, the upper and the tread piece being cooperable to define a bladder-receiving region therewithin;

(b) a flexible, non-elastic, self-contained, pressurizable bladder disposed within said bladder-receiving region, said bladder having an upper and lower surface, said bladder adapted to contain a pressurized fluid therein, the bladder being arranged such that at a predetermined number of positions a portion of the interior of the upper surface is secured to a portion of the interior of the lower surface to define a plurality of sealed regions extending substantially across and generally perpendicular to the transverse axis of said bladder and terminating a predetermined distance from the peripheral edge of the bladder, said sealed regions defining a plurality of fluid containment chambers fluidly communicable with each other, the flexibility of said bladder being sufficient to cause said sealed regions to act as joints, folding over and restricting fluid communication from one fluid containment region to another as pressure is applied to different portions of said bladder during the human gait cycle.

* * * * *